United States Patent [19]

Kun-Horn

[11] Patent Number: 4,785,751

[45] Date of Patent: Nov. 22, 1988

[54] NEEDLE PLATE ASSEMBLY FOR SEWING AND THE LIKE MACHINES

[76] Inventor: David L. Kun-Horn, No. 343, Hwa-Tzong Rd., Shyue-Jea Jenn, Tainan, Taiwan

[21] Appl. No.: 36,855

[22] Filed: Apr. 10, 1987

[51] Int. Cl.[4] ..... D05B 7/00

[52] U.S. Cl. ..... 112/27

[58] Field of Search ..... 112/25, 26, 27, 260

[56] References Cited

U.S. PATENT DOCUMENTS

| | | | |
|---|---|---|---|
| 1,685,795 | 10/1928 | Williams | 112/27 |
| 2,669,952 | 2/1954 | Getaz | 112/27 |
| 2,943,585 | 7/1960 | Crocker et al. | 112/26 |
| 3,083,655 | 4/1963 | Beck et al. | 112/27 |
| 3,292,563 | 12/1966 | Matthews | 112/25 |
| 4,190,009 | 2/1980 | Matthews | 112/25 |

*Primary Examiner*—H. Hampton Hunter

[57] ABSTRACT

The needle plate assembly comprises a walled needle plate having a compound needle hole for passage therethrough of a thread, and having a minor attachment arm portion to provide a lateral right angle aperture in the needle plate for a thread staying block which is subject to the force of a spring with the thread staying block projecting from the needle plate through the right angle aperture to be proximally engaged by respective needles.

2 Claims, 4 Drawing Sheets

NEEDLE PLATE ASSEMBLY FOR SEWING AND THE LIKE MACHINES

Sewing machines can be used for hemming of collars, sleeves of various types of overcoats and knitted woolen garments as well as for other types of similar sewing or stitch forming operations. Such machines are generally compact and easy to operate, and these machines provide an efficient processing of knitted woolen and the like garments in the garment industry. However, traditional sewing machines are confined to use ordinary cotton thread, and it is difficult to use a special thread such as a woolen and the like threads. Moreover, the thread can easily break or can become tangled, and the big or hook needle might break during operation. The connection or securement of the threads is also frequently found to be difficult, resulting in the loss of thread which makes continuous operation of the machine difficult when the strips are separated by a given distance from one another. Thus, numerous problems can occur during the sewing or stitch forming operation.

The above-mentioned difficulties are caused by the particular design of the known needle plate (see FIG. 2) which consequently has given rise to an improved type of needle plate, to which a column is attached at the lateral side next to the needle hole, while the lower edge has a flange fitted at the bottom (see FIG. 3), thereby to fix the thread firmly and to strengthen the respective thread connection. However, this improved type of needle plate has the following serious disadvantages:

1. The design is of a fixed or stationary type. It is securely installed with a small clearance with reference to the upper direction of the disk needle or needles. When a woolen knitting strip of comparatively soft texture or of a fleecy nature is to be processed, the knitting strip will not only be damaged, but the needles may become deformed under the pressure and bend while continuing to swivel or oscillate. When handling products of a comparatively strong or heavier texture, the up and down swivel motion of the disk needle will provide more oscillations, and the needles can easily hook at or be blocked by the flange part, resulting in breaking and complete shut-down of the machine.

2. The hooking connection of the threads is done with forward and backward movement of thread and this coincides with the hooking movement of the hooking conducted by the triangular thread hooking plate or element. However, when the traditional perforated needle plate (as illustrated by FIGS. 2 and 3) is used, the needle hole of the needle plate is too small, and the thread will produce friction with the wall of the hole under the hooking operation, which will cause the thread to break at times when the triangular thread hooking plate is carrying out its left and right horizontal thread hooking movements. On the other hand, if the diameter of the needle hole is too large, the knitting strip may slip from the disk needle, become lodged in the needle hole, and cause the possibility of being hooked by the triangular thread hooking plate and become damaged.

To overcome the mentioned problems, this invention is directed to an improved needle plate or needle plate assembly.

SUMMARY OF THE INVENTION

The invention relates to a safety-type needle plate or needle plate assembly and especially to the attachment to a sewing machine for handling various threads, having the advantages of making the respective thread connections easy to be carried out and precluding the tangling of threads and the damaging of the main needle and the disk needles, and which is suitable to be used under all kinds of conditions, resulting in enhanced ease of operation.

The needle plate assembly is characterized by a thread block which is controlled by a spring, and the plate is adapted to be applicable to various kinds of threads, to the effect of making thread connections or stitching easy and preventing the respective needles from breaking.

Another feature of the needle plate resides in the provision of a guide duct which is part of a compound needle hole to facilitate thread guiding; with the compound hole having a generally triangular configuration to eliminate friction between the thread and the wall of the hole during operation, thus reducing the occurrences of thread breaking and avoiding the damage of the strip.

DETAILED DESCRIPTION

Figure 4:
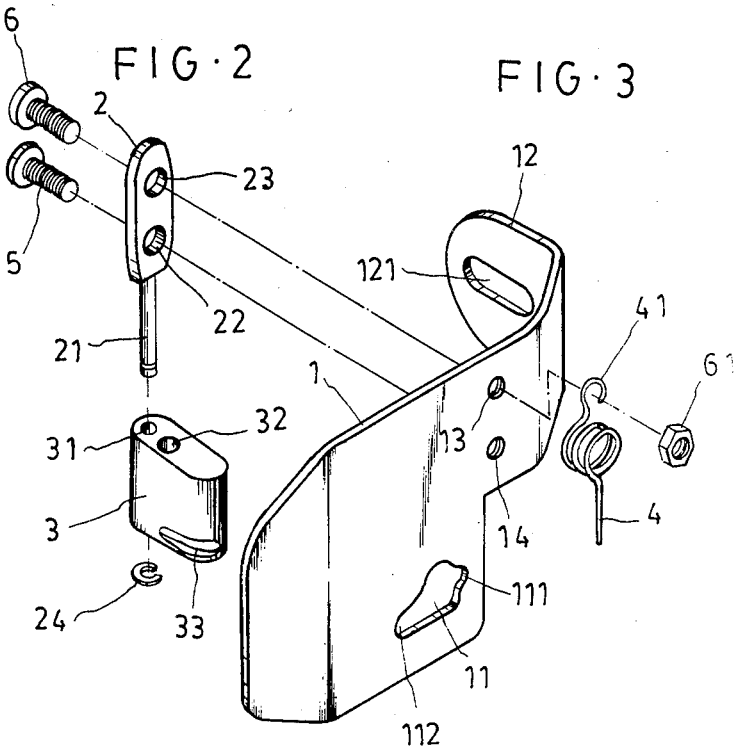
FIG. 4 is a perspective view of the safety-type needle plate assembly in accordance with one embodiment of the inventin.

With reference to FIG. 4, there are provided a perforated needle plate 1, a fulcrum lever block 2, a thread staying or thread block 3, a coil spring 4, and associated assembly members.

A compound needle hole 11 is provided in major portion of the needle plate 1. The needle hole 11 includes at the right or lateral wall a lateral concave thread guiding duct or recess 111, and at the left side the needle hole 11 extends in the shape of a semicircular or arcuate hole 112 from the horizontal base which is generally parallel to the bottom edge of the needle plate 1.

Figure 5:
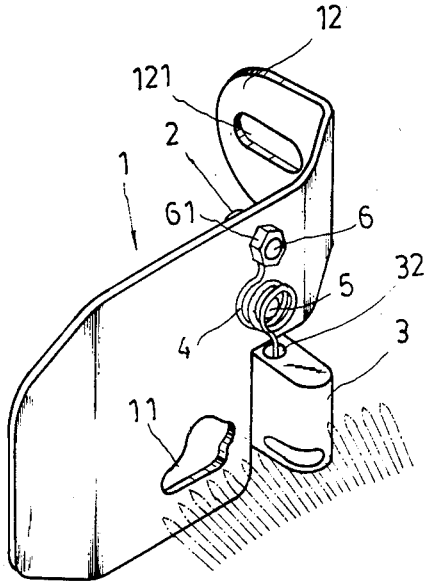
FIG. 5 is a first perspective view of the needle plate.
Figure 5A:
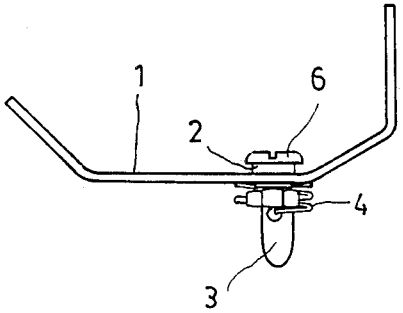
FIG. 5A is a top plan view of the needle plate assembly.

There are a spring attachment hole 13 and a screw hole 14 at the upper terminus or minor attachment arm portion 12 of needle plate 1. With reference to FIG. 5A, the minor attachment arm 12 extends to the rear at an upper position of the needle plate 1, and it has an attachment hole 121 for securing the attachment part 12 at the respective sewing machine.

With reference to FIG. 4, the upper part of the fulcrum lever or fulcrum lever block 2 is a generally oval block, with a fulcrum lever hole 31 and a spring stay hole 32. A guiding duct 33 is provided at the bottom edge of the thread block 3. The upper end of the spring 4 has a hook terminus 41, and the spring has a lower straight terminus which is secured in the spring stay hole 32.

With reference to FIG. 4, the fulcrum lever 21 of the fulcrum lever block 2 can be introduced into the fulcrum lever hole 31 of the block 3. A retaining ring 24 serves to secure the lever 21 with respect to the thread block 3. Screws 5 and 6 will connect and lock the fulcrum lever block 2 at the needle plate 1 by extending through the round holes 22 and 23, respectively, whereby the front end of the thread block 3 projects from the front wall of the needle plate 1 as shown in FIGS. 4 and 5. The lower end of the spring 4 should first be inserted into the spring stay hole 32 of the block 3.

The hook terminus 41 of the spring 4 is secured by screw 6, and a nut 61 but allowing spring operation of spring 4. Thus, the block 3 with its thread guide duct 33 at the lower edge of the thread block 3 is operatively attached at the needle plate 1 with the effect that guiding of a thread (81) is easy, as well as preventative of damage of the needles 7 of the respective machine.

Figure 1:
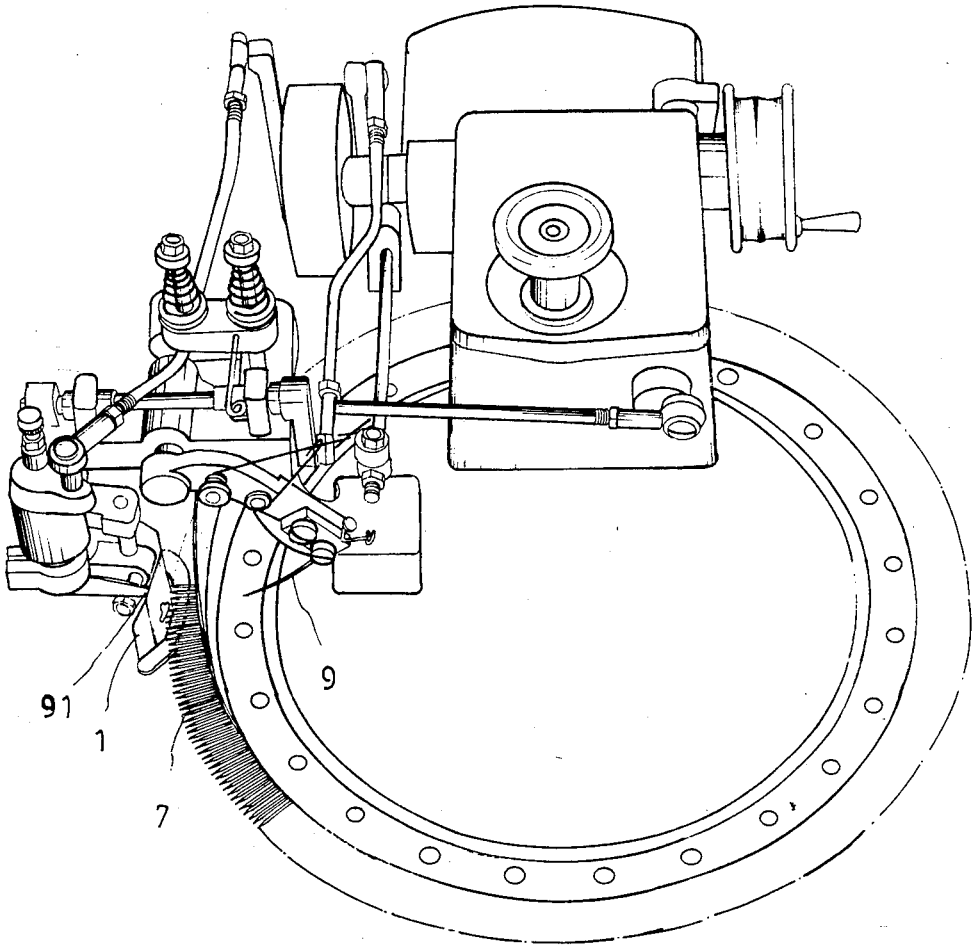
FIG. 1 is a diagram relating a needle plate assembly and a sewing machine.
Figure 2:
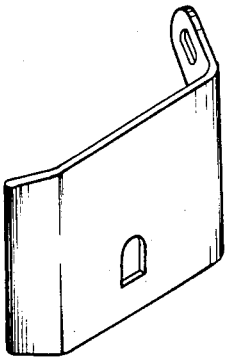
FIG. 2 is a perspective view of a prior art needle plate.
Figure 3:
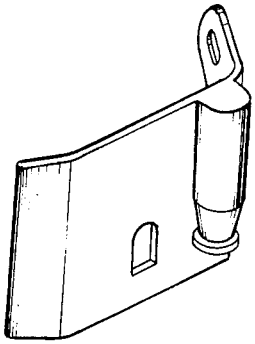
FIG. 3 is a perspective view of a further prior art needle plate.
Figure 6:
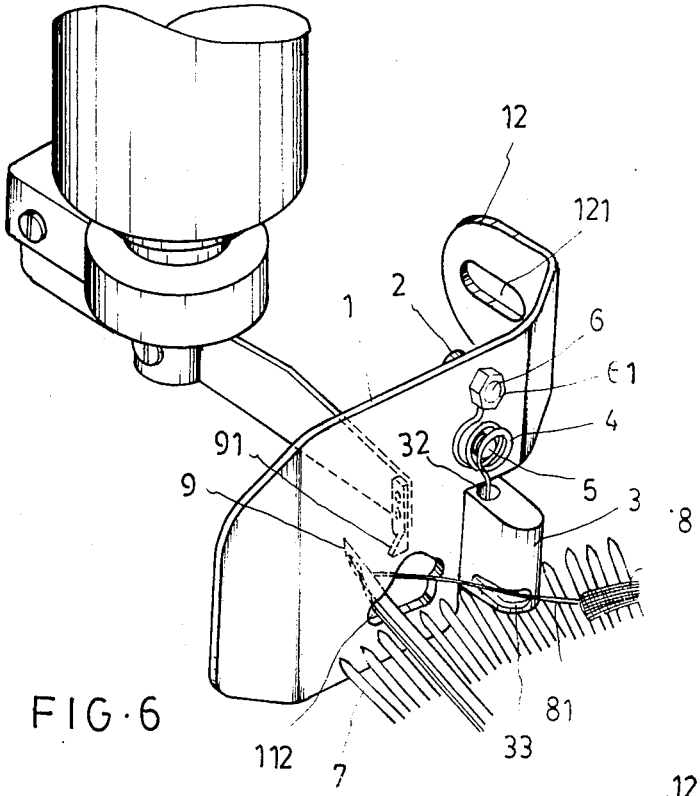
FIG. 6 is a second perspective view of the safety-type needle plate assembly also showing the thread hooking plate.
Figure 8:
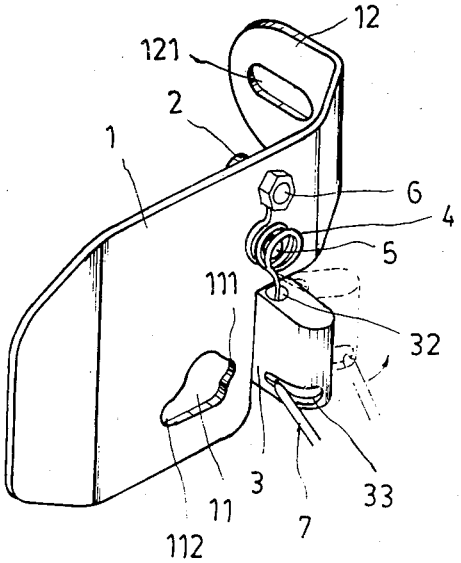
FIGS. 8 and 9 are further perspective views illustrating the function of the thread block.

With reference to FIG. 6, which illustrates how the assembly is installed at a sewing machine, the needle plate 1 is firmly secured at the body of the sewing machine by means of the attachment or anchor hole 121 of the attachment part 12 (please refer to FIGS. 1 and 5). Accordingly, the needle plate 1 is located near the needles 7 of the sewing machine, and the lower edge of the needle plate 1 extends generally at the same level as the needles 7, with the front end of the thread lock 3 extending between needles 7, and with a small clearance close to the needles 7.

With reference to FIGS. 1 and 6, after the knitting material or strip (such as a collar, sleeve, etc.) has been mounted on the needles 7, it will advance following the rotation of needles 7, and will be secured by means of the shuttling and connecting movement of the hook needle 9 and the triangular thread hooking plate 91. Since the strips are sewn continuously strip by strip (or piece by piece), a thread interconnecting such strips should be continuous, and any connection should be secure and taut. Otherwise, the thread may interfere and render proper advancing of successive strips impossible. The needle plate 1 can maintain the thread in a tight manner by means of the thread block 3, and at the same time, through the guiding function provided by the thread guiding duct 111, part of the compound needle hole 11, ensure the proper forward movement of the thread. Consequently, the hooking action of the triangular thread hooking plate 91 is made easily and assuredly, without causing the thread to hand loosely and to make the sewing operation of strips difficult.

Figure 7:
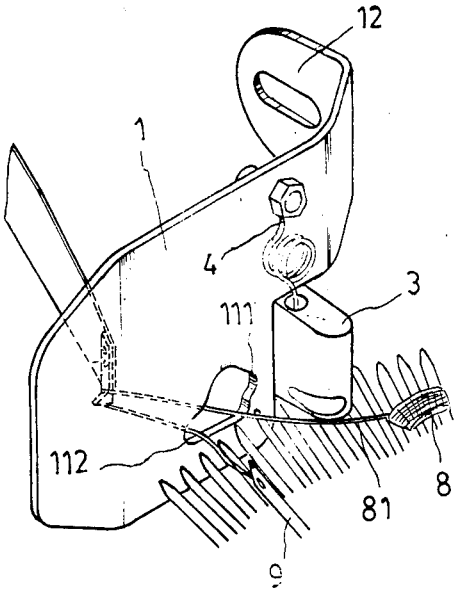
FIG. 7A is a thread position diagram illustrating the thread position in the prior art needle plate.
FIG. 7B is a position diagram illustrating the position of the thread in the needle plate according to one embodiment of the invention.
Figure 7A:
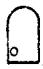
Figure 7B:
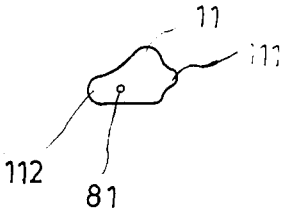

FIG. 7 illustrates the functioning of the hole 112 at the rear lateral lower direction of the needle hole 11. The respective connections of the thread are by means of shuttling and hooking movements of the hook needle 9 and the triangular thread hooking plate 91 with the hook needle 9 carrying out forward and backward movements in a straight line, while the triangular thread hooking plate 91 is shuttling in left and right directions. When the triangular thread hooking plate 91 is in the position indicated by FIG. 7, in conformity with the movement of the triangular thread hooking plate 91, the thread will move in sideward direction. At this time, in the case of the prior art needle plates, thread breaking will often occur when the thread is frictionally engaging the wall of the small hole (as shown by FIG. 7A). However, because of the compound nature of hole 11 of the needle plate 1, the friction is substantially reduced, as is shown by FIG. 7B, showing the relative position of the thread 81. Moreover, the thread block 3 also provides safety functions for the needles 7.

When disk needles 7 contact the thread block 3, the latter will swivel and rotate about the fulcrum lever 21 while accompanying the forward movement of the disk needles 7, and the latter, in turn, will gradually and smoothly disengage from the block 3. The block 3 is actuated against the force of spring 4 and it will be returned to its rest position after the disk needle 7 has passed along the front of the block 3, and the block 3 can continue its function of thread staying.

Figure 9:
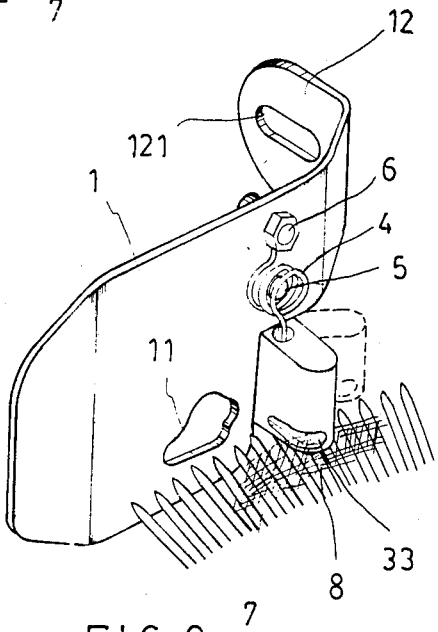

With reference to FIG. 9, when a needle 7 engages the bottom lateral part of the block 3, the clearance increases and the cloth or thread may enter and cause problems; however, the thread block 3 can swivel and move out of the way to preclude obstruction. The block 3 can return to its original position by means of spring 4, to again conduct its thread staying function.

The needle plate 1 provides the following advantages: The thread staying block 3 is tightly staying the thread. The thread moves forward more stably due to the guiding duct 111. Threads can be easily connected and do not tend to fall down during operation of the triangular thread hooking plate 91 due to an appropriate degree of tightness, so as to make the assembly especially suitable for the processing of various threads.

The block 3 can swivel subject to the force of the spring 4. Moreover, the compound needle hole 11 will reduce friction and consequently, minimize the thread breakage.

The needle plate 1 is able to solve problems commonly found in the machines to date and it provides an assembly of simple components. The needle plate substantially reduces breakdown of the machine, provides cost savings, and increases work efficiency.

I claim:

1. A needle plate assembly for sewing and the like machines, said assembly comprising:

a walled needle plate having a major portion with a compound needle hole for passage therethrough of a thread, and having a minor attachment arm portion to provide a lateral right angle aperture in said walled needle plate for a respective thread staying block, said minor attachment arm portion having attachment holes respectively positioned above said compound needle hole when considered in the installed position at a sewing machine;

a fulcrum lever block with a flat upper terminus adapted to be secured to said needle plate and a column-shaped lower terminus;

a thread staying block of oval cross section having a fulcrum lever hole for receiving said column-shaped lower terminus of said fulcrum lever, and having a spring retaining hole forwardly spaced from said fulcrum lever hole when considered in the installed position; said thread staying block being adapted to be secured at said needle plate in such a way that it projects from the forward wall of said needle plate and through said right angle aperture to be proximally engaged by respective needles of said machine; and a spring having an upper hook-shaped terminus for securement at said needle plate and having a straight terminus adapted to be operatively connected in said spring retaining hole of said thread block; said spring allowing operative movement of said thread staying block with respect to the moving path of respective needles but precluding damage of needles.

2. The needle plate of claim 1, wherein said compound needle hole is of approximately triangular configuration with rounded corners, and formed by a straight base, a first side rounded towards said base and a second side rounded away from said base to provide a thread guide duct allowing lateral movement of a respective thread

* * * * *